US011688990B2

(12) United States Patent
Chang et al.

(10) Patent No.: US 11,688,990 B2
(45) Date of Patent: Jun. 27, 2023

(54) TERMINAL STRUCTURE OF HIGH-FREQUENCY SIGNAL CONNECTOR AND MANUFACTURING METHOD THEREOF

(71) Applicant: T-CONN PRECISION CORPORATION, New Taipei (TW)

(72) Inventors: Jen-Hao Chang, New Taipei (TW); Chien-Hung Lu, New Taipei (TW)

(73) Assignee: T-CONN PRECISION CORPORATION, New Taipei (TW)

( * ) Notice: Subject to any disclaimer, the term of this patent is extended or adjusted under 35 U.S.C. 154(b) by 379 days.

(21) Appl. No.: 16/990,268

(22) Filed: Aug. 11, 2020

(65) Prior Publication Data

US 2021/0384690 A1 Dec. 9, 2021

(30) Foreign Application Priority Data

Jun. 5, 2020 (TW) ..... 109118969

(51) Int. Cl.
*H01R 43/16* (2006.01)
*H01R 13/24* (2006.01)
*H01R 43/08* (2006.01)

(52) U.S. Cl.
CPC ..... *H01R 43/16* (2013.01); *H01R 13/2414* (2013.01); *H01R 43/08* (2013.01)

(58) Field of Classification Search
CPC ..... H01R 43/16; H01R 13/2414; H01R 43/08
See application file for complete search history.

(56) References Cited

U.S. PATENT DOCUMENTS 5,044,071 A * 9/1991 Toda ..... H01L 21/67138 257/668
7,621,788 B1 * 11/2009 Feng ..... H01R 43/16 439/885
9,515,438 B1 * 12/2016 Chang ..... H01R 13/6474
10,008,793 B2 * 6/2018 Ju ..... H01R 24/00
10,038,260 B2 * 7/2018 Ju ..... B29C 63/00
(Continued)

FOREIGN PATENT DOCUMENTS

CN 103311776 B * 11/2015
CN 208690560 U * 4/2019 ..... H01R 13/02
JP H11224737 A * 8/1999

*Primary Examiner* — Peter Dungba Vo
*Assistant Examiner* — Jose K Abraham
(74) *Attorney, Agent, or Firm* — Bacon & Thomas, PLLC

(57) ABSTRACT

A terminal structure of a high-frequency signal connector and a manufacturing method thereof, in which multiple first terminals and multiple second terminals, multiple excavation areas and multiple trimming lines are trimmed from a tape, the first terminals and the second terminals are arranged alternately, each of the trimming lines is located between one of the first terminals and one of the second terminals that are disposed next to each other, followed by stamping the first terminals and the second terminals to form a first terminal set and a second terminal set. The first terminals and the second terminals are formed simultaneously on a single tape, and in turn, the period for fabricating dies and developing dies may be reduced, and less metal tapes is wasted after blanking of the first terminals and the second terminals, in order to decrease processes and reduce a manufacturing cost of the connector effectively.

8 Claims, 10 Drawing Sheets

(56) References Cited

U.S. PATENT DOCUMENTS

| | | | | |
|---|---|---|---|---|
| 10,411,375 | B2 * | 9/2019 | Ju | H01R 12/712 |
| 10,439,308 | B2 * | 10/2019 | Ju | H01R 43/18 |
| 10,468,796 | B2 * | 11/2019 | Ju | H01R 13/6585 |
| 2002/0022407 | A1 * | 2/2002 | Niitsu | H01R 13/658 439/676 |
| 2002/0168897 | A1 * | 11/2002 | Chang | H01R 13/6581 439/607.01 |
| 2008/0176449 | A1 * | 7/2008 | Hu | H01R 12/716 439/607.01 |
| 2009/0023338 | A1 * | 1/2009 | He | H01R 13/6582 29/883 |
| 2009/0124133 | A1 * | 5/2009 | Tsai | H01R 43/16 439/660 |
| 2010/0178794 | A1 * | 7/2010 | Hsu | H01R 43/00 29/883 |
| 2011/0059656 | A1 * | 3/2011 | Tsai | H01R 12/716 439/660 |
| 2012/0208402 | A1 * | 8/2012 | Lee | H01R 43/24 439/626 |
| 2013/0344739 | A1 * | 12/2013 | Shih | H01R 12/721 439/607.28 |
| 2017/0133797 | A1 * | 5/2017 | Guo | H01R 13/6585 |
| 2017/0194748 | A1 * | 7/2017 | Peng | H01R 13/6585 |
| 2017/0279234 | A1 * | 9/2017 | Tsai | H01R 13/6585 |
| 2017/0294753 | A1 * | 10/2017 | Wu | H01R 43/24 |
| 2020/0091659 | A1 * | 3/2020 | Tada | H01R 43/16 |

* cited by examiner

TERMINAL STRUCTURE OF HIGH-FREQUENCY SIGNAL CONNECTOR AND MANUFACTURING METHOD THEREOF

BACKGROUND OF THE INVENTION

Field of the Invention

The invention relates to a terminal structure of a high-frequency signal connector and the manufacturing method thereof, and in particular, to a terminal structure of a high-frequency signal connector and the manufacturing method thereof capable of reducing the period for fabricating dies and development of dies, as well as reducing waste for metal conducting materials after blanking of each first terminal and each second terminal, in order for decreasing processes and reducing a manufacturing cost of the connector effectively.

Descriptions of the Related Art

Due to doubling of transmission speed for the new generation of HDMI high-frequency signals, the advantage of low loss is required, and also, the advantage of reducing manufacturing cost is necessary. However, for terminals of a conventional HDMI (High Definition Maltimedia Inter face) electrical connector, a two-piece approach is used to provide one tape for each upper and a lower terminal sets, respectively, to manufacture two sets of terminals. Accordingly, two sets of dies and assembly lines are needed, such that both processes and cost of materials are increased.

SUMMARY OF THE INVENTION

The main objective of the invention is to avoid the persistence of the conventional prior arts mentioned above, in which each first terminal set and each second terminal set may be stamped and formed simultaneously on a single tape, and in turn, the period or time for fabricating dies and development of dies may be reduced, and less material waste is available for a metal tape after blanking of each of the first terminals and each of the second terminals, in order to achieve the advantage of reducing the process and manufacturing cost of the connector effectively.

In order to achieve the objective of the present invention, the invention refers to a method for manufacturing terminals of a high-frequency signal connector, in which multiple first terminals and multiple second terminals, multiple excavation areas and multiple trimming lines are trimmed from a tape, each of the first terminals is located on one side of each of the second terminals, each of the excavation areas and each of the trimming lines are located between each of the first terminals and each of the second terminals, respectively, followed by stamping each of the first terminals and each of the second terminals to form the multiple first terminals and the multiple second terminals.

In the preferred embodiment of the invention, a terminal structure of a high-frequency signal connector is provided, including: multiple first terminals, multiple second terminals, and multiple excavation areas. Respective first terminals constitute an upper terminal set, respective second terminals constitute a lower terminal set, and each of the first terminal is located on one side of each of the second terminals; each of the excavation area is located between each of the first terminals and each of the second terminals for reducing an area of each of the terminals to reduce a characteristic impedance.

In the terminal structure of the high-frequency signal connector and the manufacturing method thereof, the tape may be trimmed to meet dimension specifications with respect to lengths for each of the first terminals and each of the second terminals.

In the terminal structure of the high-frequency signal connector and the manufacturing method thereof, the tape may be trimmed to meet the dimension specifications with respect to the lengths for each of the first terminals and each of the second terminals when each of the first terminals and each of the second terminals are trimmed from the tape.

In the terminal structure of the high-frequency signal connector and the manufacturing method thereof, each of the excavation areas may be formed in a shape of an extended bar, a circle, a square, a diamond, or a trapezoid.

DETAILED DESCRIPTION OF THE PREFERRED EMBODIMENT

Figure 1:
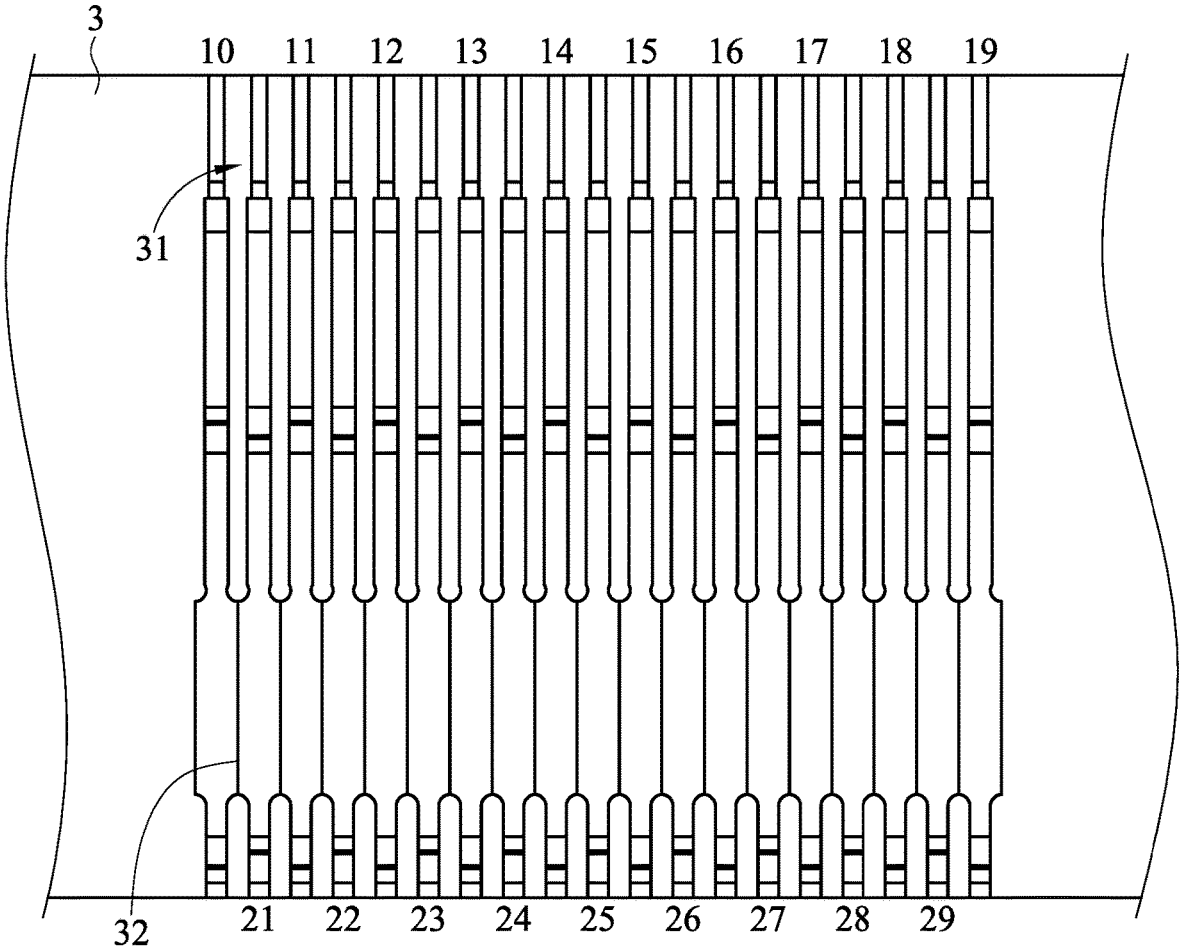
FIG. 1 is a schematic diagram showing the appearance for a first embodiment according to the invention.
Figure 2:
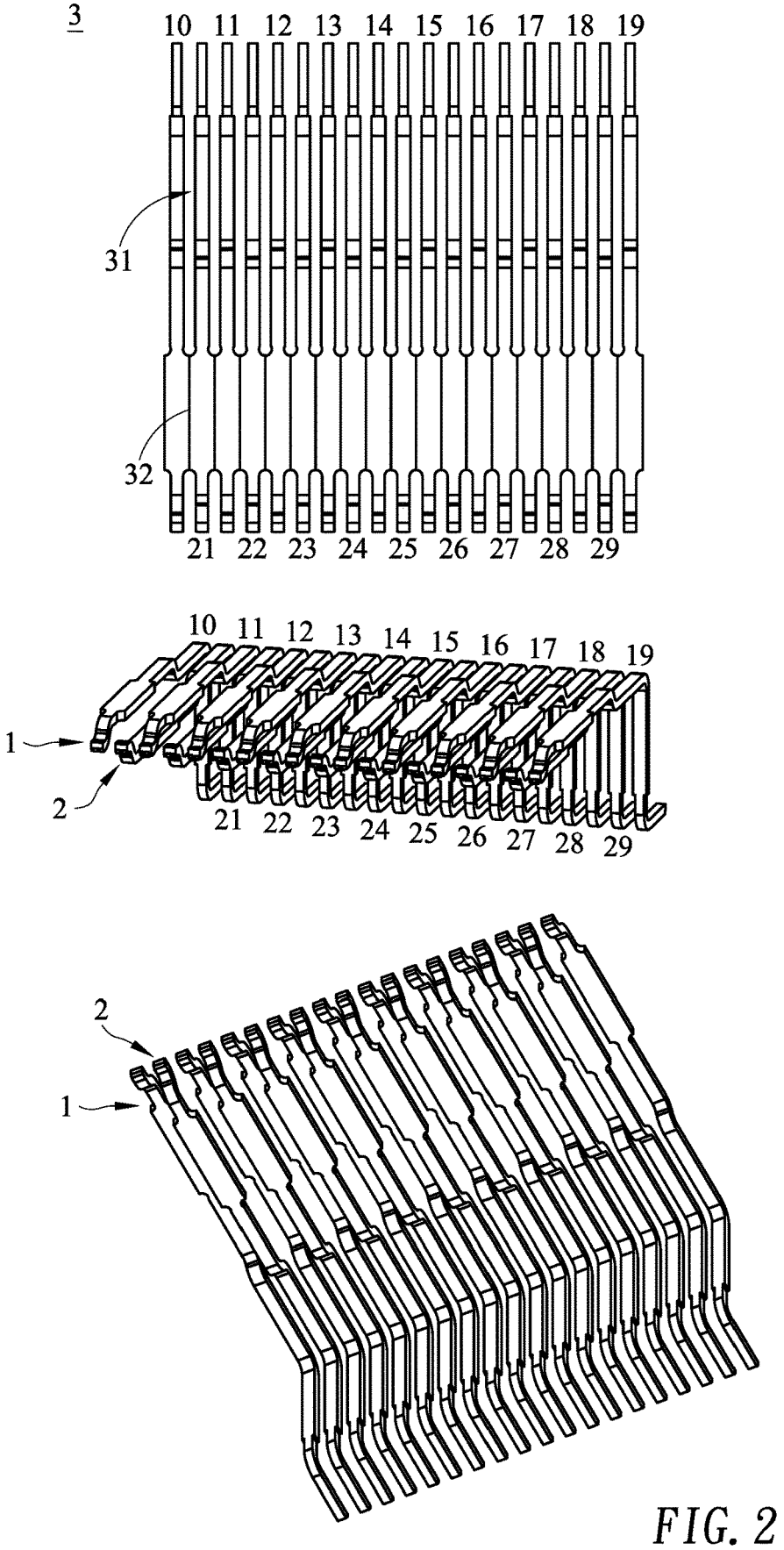
FIG. 2 is a schematic diagram showing stereoscopic appearances of a tape, a first terminal set, and a second terminal set for the first embodiment according to the invention.

Referring to FIGS. 1 and 2, the present invention refers to a terminal structure of a high-frequency signal connector and the manufacturing method thereof. In the manufacturing method, multiple first terminals 10, 11, 12, 13, 14, 15, 16, 17, 18, 19 and multiple second terminals 21, 22, 23, 24, 25, 26, 27, 28, 29, multiple excavation areas 31 and multiple trimming lines 32 are trimmed from a tape 3; the first terminals 10~19 and the second terminals 21~29 are arranged alternately; and each of the trimming lines 32 is located between one of the first terminals 10~19 and one of the second terminals 21~29 that are disposed next to each other. The multiple first terminals 10~19 and the multiple second terminals 21~29 are divided into multiple pairs of terminals. Each of the pairs of terminals includes one of the first terminals 10~19 and one of the second terminals 21~29 that are disposed next to each other. Each of the excavation areas 31 is only formed between the first terminal 10~19 and the second terminal 21~29 of one of the pairs of terminals. Specifically, the excavation areas 31 are formed between the first terminal 10 and the second terminal 20, between the first terminal 11 and the second terminal 21, and even between the first terminal 18 and the second terminal 29. Followed by stamping the first terminals 10~19 and the second terminals 21~29, the multiple first terminals 10~19 form a first terminal set 1 and the multiple second terminals 21~29 form a second terminal set 2. In this way, the first terminal set 1 and the second terminal set 2 may be formed on a tape 3 simultaneously, and in turn, one assembly line may be saved and the period for fabricating dies and development of dies may be reduced, and less material waste is available for metal tape conducting materials after blanking of each of the first terminals 10~19 and each of the second terminals 21~29, therefore to achieve the advantages of decreasing processes and reducing a manufacturing cost of the connector effectively.

As shown in the figures, the first terminals 10, 11, 12, 13, 14, 15, 16, 17, 18, 19 and the second terminals 21, 22, 23, 24, 25, 26, 27, 28, 29 are arranged in a cross form on the terminal tape 3 in order, respectively, portions of the tape 3 are excavated between each of the first terminals 10~19 and each of the second terminals 21~29 to form multiple excavation areas 31, and multiple trimming lines 32 are provided on adjacent boundaries of the tape 3 without excavation between each of the first terminals and each of the second terminals. After the step of excavating the portions of the tape 3 for the excavation areas 31 is completed for the tape 3 and each of the terminals are resulted via trimming along each of the trimming lines 32, each of the first terminals and each of the second terminals are stamped simultaneously, such that the first terminals 10~19 are stamped upward to form an upper terminal set, namely the first terminal set 1, and the second terminals 21~29 are stamped downward to form a lower terminal set, namely the second terminal set 2.

Figure 3:
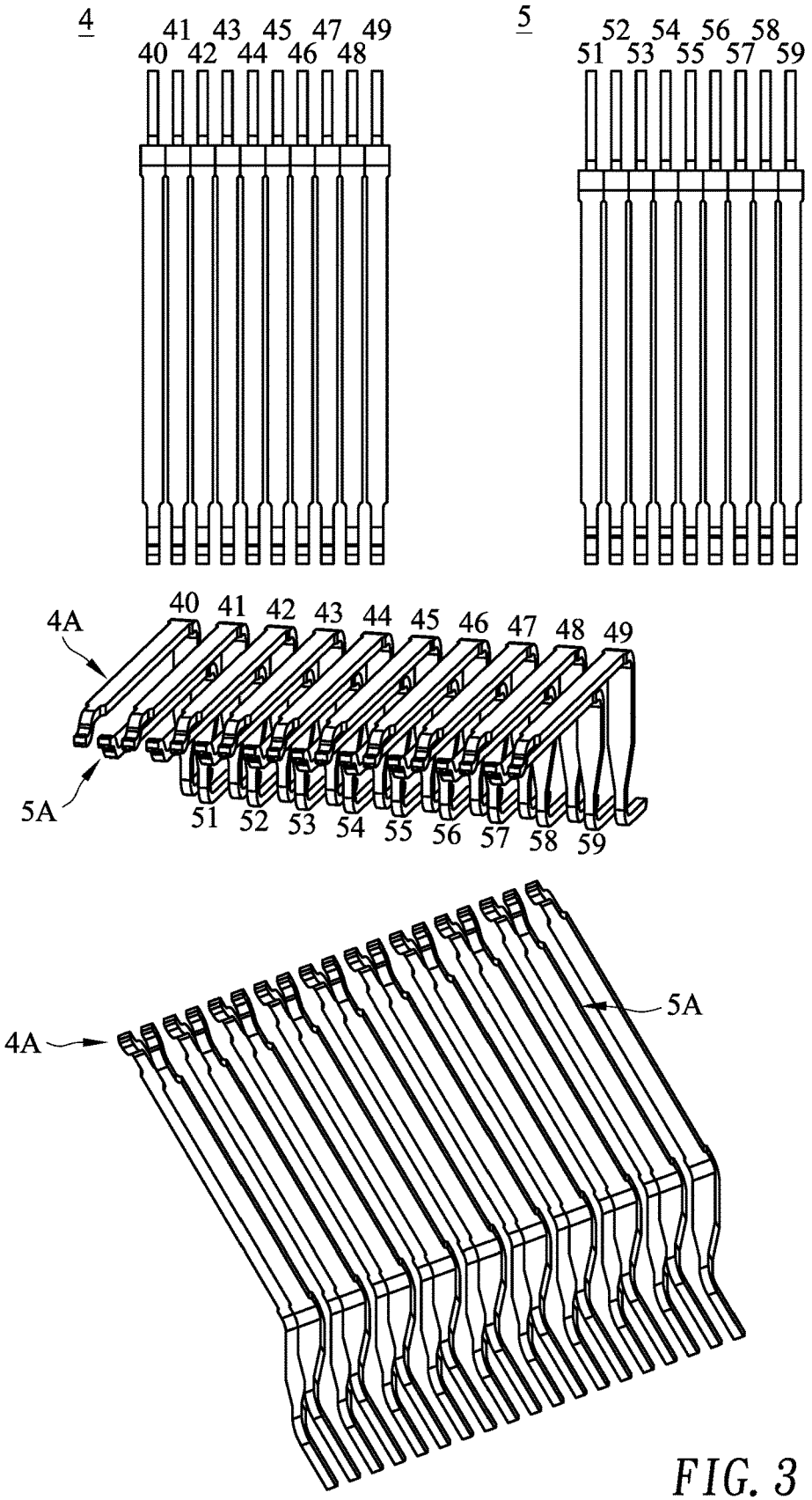
FIG. 3 (Prior Art)
FIG. 3 is a schematic diagram showing stereoscopic appearances of a first tape, a second tape, a first terminal set and a second terminal set for a conventional prior art.

Referring to FIG. 3, two tapes, namely a first tape 4 and a second tape 5, need to be provided for a conventional process of HDMI electrical connector terminals. In manufacturing the terminal sets, two assembly lines need to be disposed, respectively, in which one assembly line is used for trimming the first tape 4 to fabricate first terminals 40, 41, 42, 43, 44, 45, 46, 47, 48, 49, followed by stamping the first terminals 40~49 to form an upper terminal set, namely a first terminal set 4A; and the other assembly line is used for trimming a second tape 5 to fabricate second terminals 51, 52, 53, 54, 55, 56, 57, 58, 59, followed by stamping the second terminals 51~59 to form a lower terminal set, namely a second terminal set 5A.

Therefore, two assembly lines need to be disposed for the conventional two-piece tape process in order for providing two tapes 4 and 5, and two sets of dies are required to fabricate the two sets of terminals (an upper rank of terminals and a lower rank of terminals), namely the first terminal set 4A and the second terminal set 5A. However, the method for manufacturing terminal sets with a one-piece tape according to the present invention requires only disposition of one assembly line, provision of one single tape 3 and development of one set of dies, which is able to fabricate two types of terminals (an upper rank of terminals and a lower rank of terminals), namely the first terminal set 1 and the second terminal set 2. Accordingly, compared to the process of the conventional prior art, in the invention, the expense for one set of dies may be eliminated and the cost for development of dies may be reduced, while one assembly line of terminals is eliminated to reduce the loss of materials due to blanking of two tapes, such that the cost for manufacturing HDMI electrical connectors may be reduced significantly and the invention contributes to a great economic benefit.

In a first preferred embodiment according to the invention, the tape 3 may be trimmed in advance to meet dimension specifications with respect to lengths for each of the first terminals 10~19 and each of the second terminals 21~29. In this way, the first terminal set 1 and the second terminal set 2 may be formed on a tape 3 simultaneously, and in turn, the period or time for fabricating dies and development of dies may be reduced, and less material waste is available for metal tape conducting materials after blanking of each of the first terminals 10~19 and each of the second terminals 21~29, in order to achieve effective reduction of manufacturing cost for HDMI electrical connectors, such that the present invention can practically meet the requirement of industrial utilization.

In the first embodiment according to the invention, the tape 3 may be trimmed to meet the dimension specifications with respect to the lengths for each of the first terminals 10~19 and each of the second terminals 21~29 when each of the first terminals 10~19 and each of the second terminals 21~29 are resulted via trimming from the tape 3. In this way, the first terminal set 1 and the second terminal set 2 may be formed on a tape 3 simultaneously, and in turn, the period or time for fabricating dies and development of dies may be reduced, and less material waste is available for metal tape conducting materials after blanking of each of the first terminals 10~19 and each of the second terminals 21~29, in order to achieve effective reduction of manufacturing cost for connectors, such that the invention can practically meet the requirement of industrial utilization.

Figure 4:
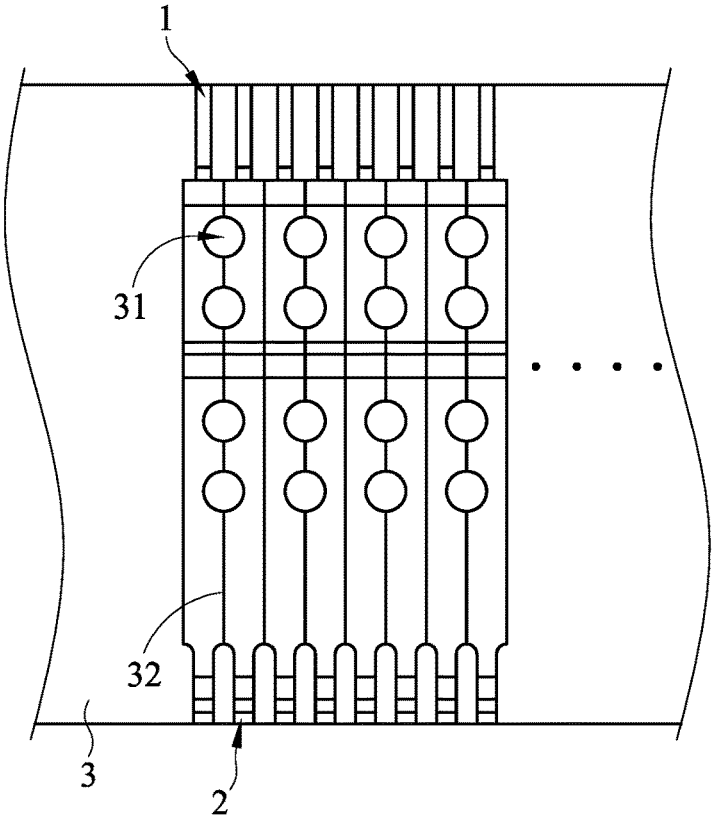
FIG. 4 is a schematic diagram showing the appearance for a second embodiment according to the invention.
Figure 5:
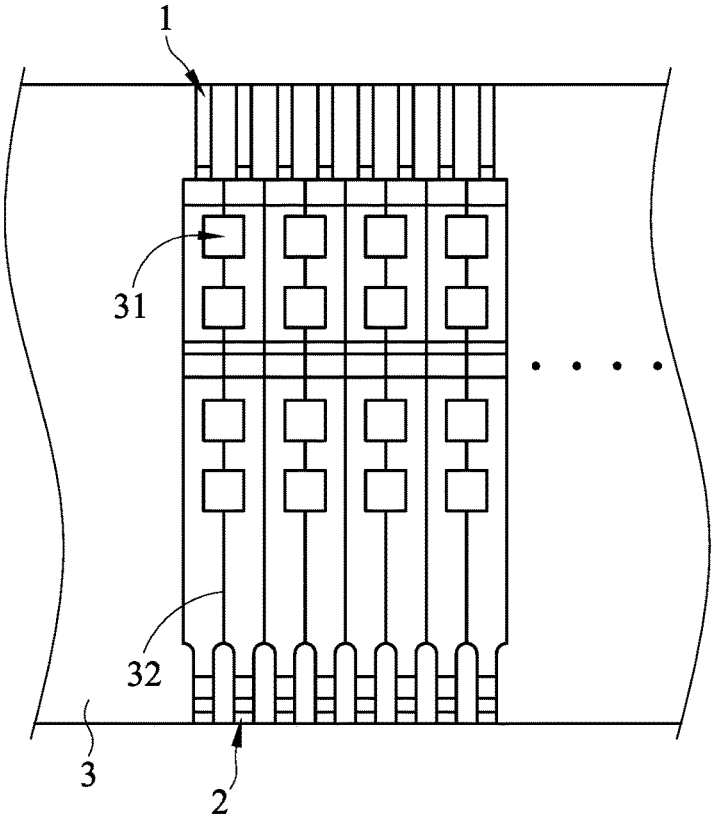
FIG. 5 is a schematic diagram showing the appearance for a third embodiment according to the invention.
Figure 6:
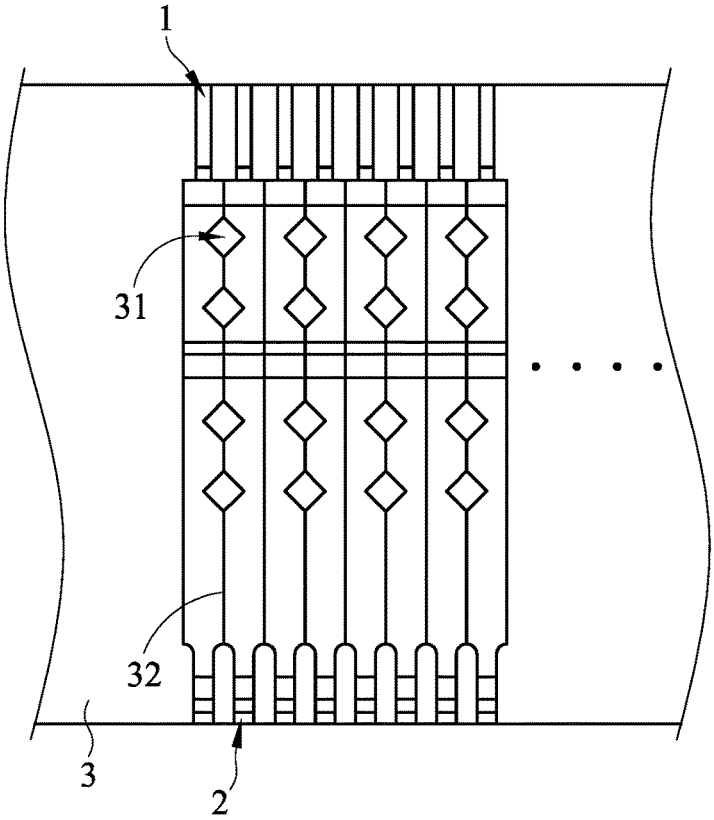
FIG. 6 is a schematic diagram showing the appearance for a fourth embodiment according to the invention.
Figure 7:
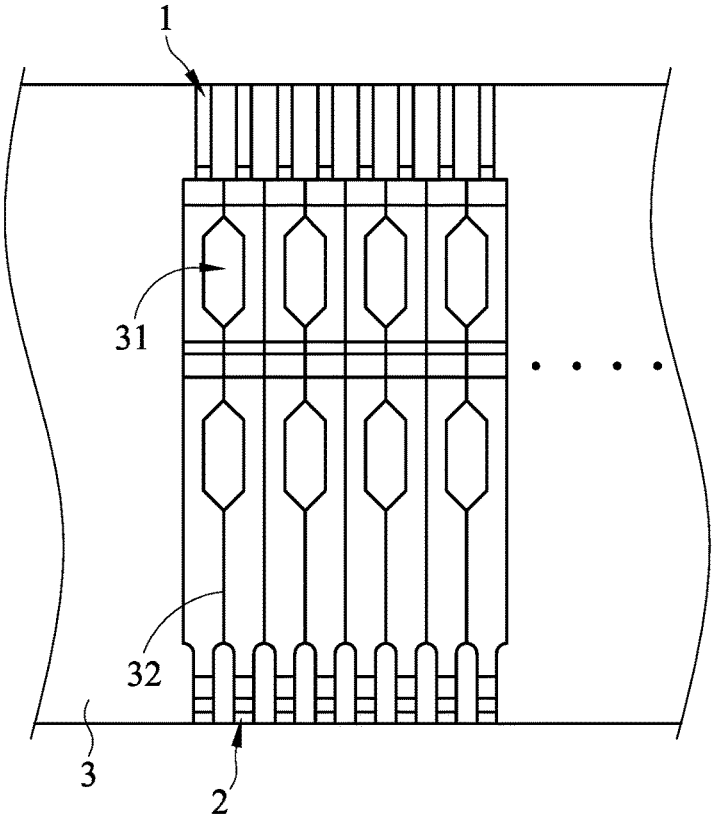
FIG. 7 is a schematic diagram showing the appearance for a fifth embodiment according to the invention.

In the preferred embodiment according to the invention, each excavation area 31 may be formed in a shape of an extended bar (as shown in FIG. 1), a circle (as shown in FIG. 2), a square (as shown in FIG. 3), a diamond (as shown in FIG. 4), or a trapezoid (as shown in FIG. 5). In this way, the characteristic impedance of the terminal may be reduced through reduction of the area on the terminals by means of each of the excavation areas 31 provided, such that the electrical connector of the invention may meet the specifications of current HDMI 2.1 characteristics.

Figure 12:
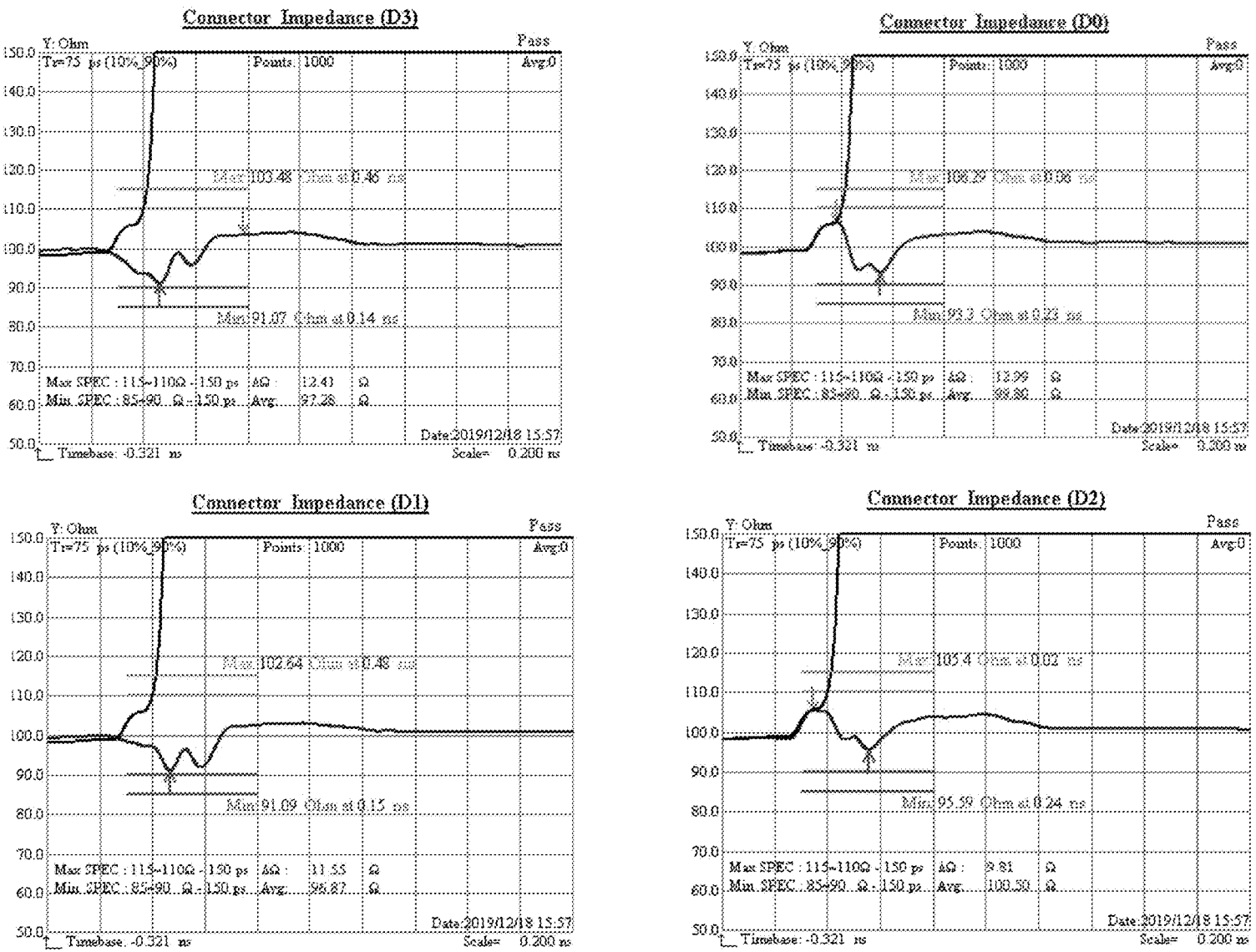
FIG. 12 is an impedance test chart showing how the electrical connector of the invention may meet the specifications of current HDMI 2.1 requirement.

In the embodiment according to the invention, as shown in FIG. 2, the invention provides a terminal structure of a high-frequency signal connector, including: multiple first terminals 10~19, multiple second terminals 21~29, and multiple excavation areas 31. The first terminals 1019 are and the second terminals 21~29 are arranged alternately. The multiple first terminals 10~19 and the multiple second terminals 21~29 are divided into multiple pairs of terminals. Each of the pairs of terminals includes one of the first terminals 10~19 and one of the second terminals 21~29 that are disposed next to each other. Each of the excavation areas 31 is only formed in a side, which is disposed toward the second terminal 21~29 of the same pair of terminals, of the first terminal 10~19 and a side, which is disposed toward the first terminal 10~19 of the same pair of terminals, of the second terminal 21~29 of one of the pairs of terminals. As shown in FIGS. 4 to 7, take the first terminal 10 and the second terminal 21 of the same pair of terminals as an example. Each of the excavation areas 31 is symmetrically formed in a right side of the first terminal 10 and a left side of the second terminal 21. The first terminals 10~19 constitute an upper terminal set of the connector, namely the first terminal set 1, and the second terminal sets 21~29 constitute a lower terminal set of the connector, namely the second terminal set 2. Each of the excavation areas 31 may be formed in a shape of an extended bar, a circle, a square, a diamond, or a trapezoid. In this way, the characteristic impedance of the terminal may be reduced through reduction of the area on the terminals by means of each of the excavation areas 31 provided, such that the electrical connector of the invention may meet the specifications of current HDMI 2.1 requirement, as shown in FIG. 12.

Figure 8:
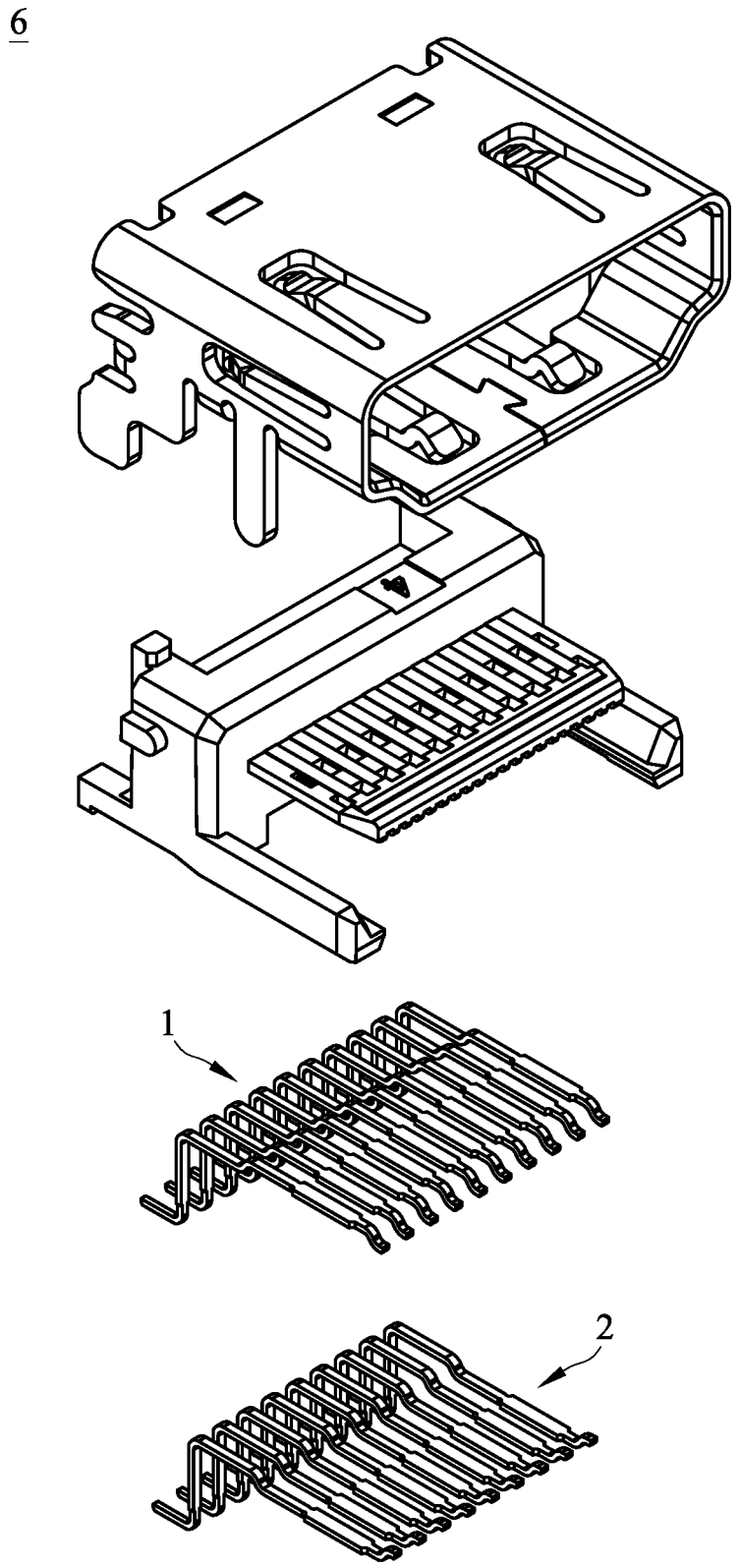
FIG. 8 is a diagram showing stereoscopic appearances for the first embodiment according to the invention applied to a first terminal set and a second terminal set of a high-frequency signal connector.
Figure 9:
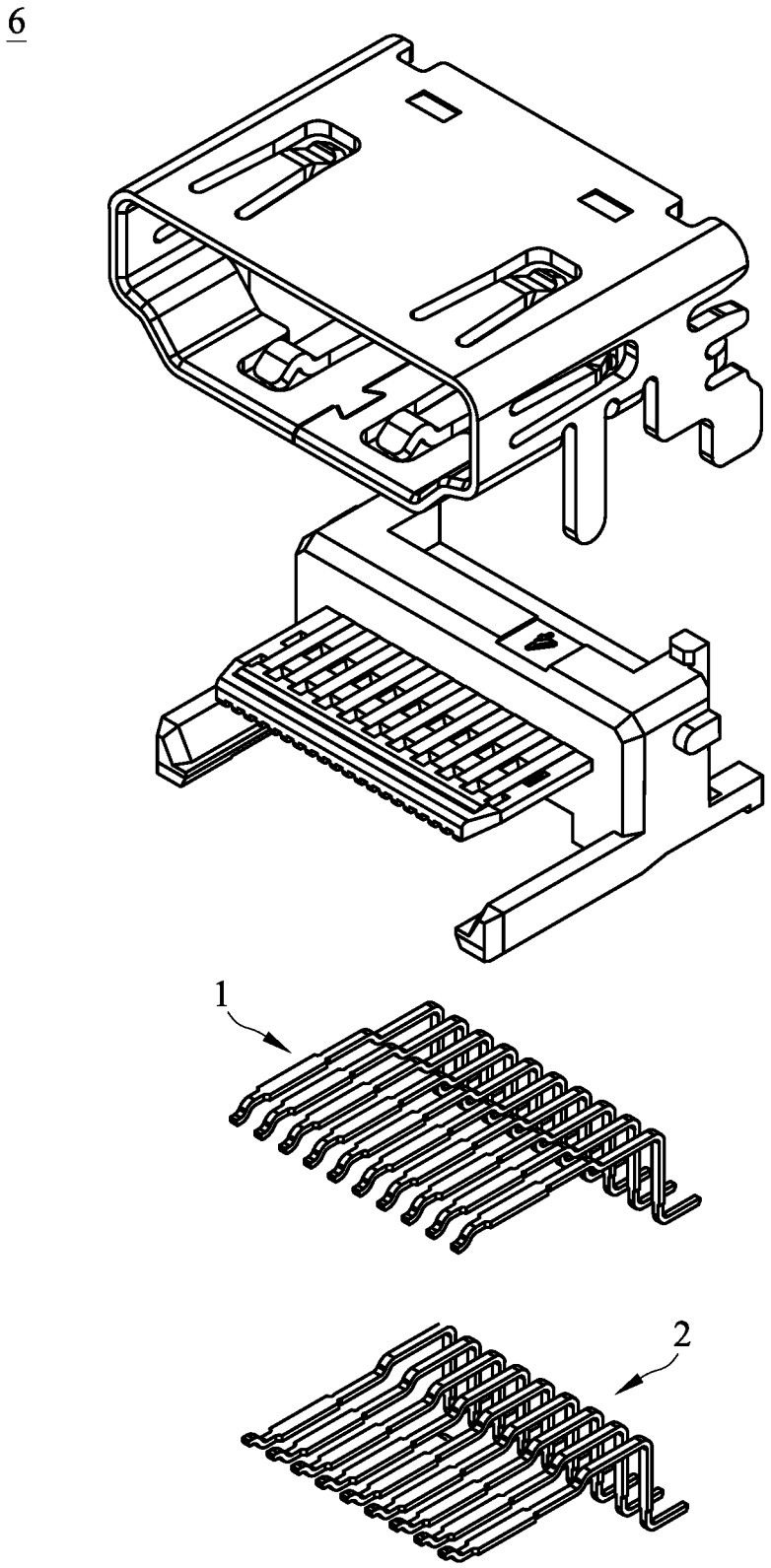
FIG. 9 is diagram showing stereoscopic appearances for FIG. 8 from another perspective.
Figure 10:
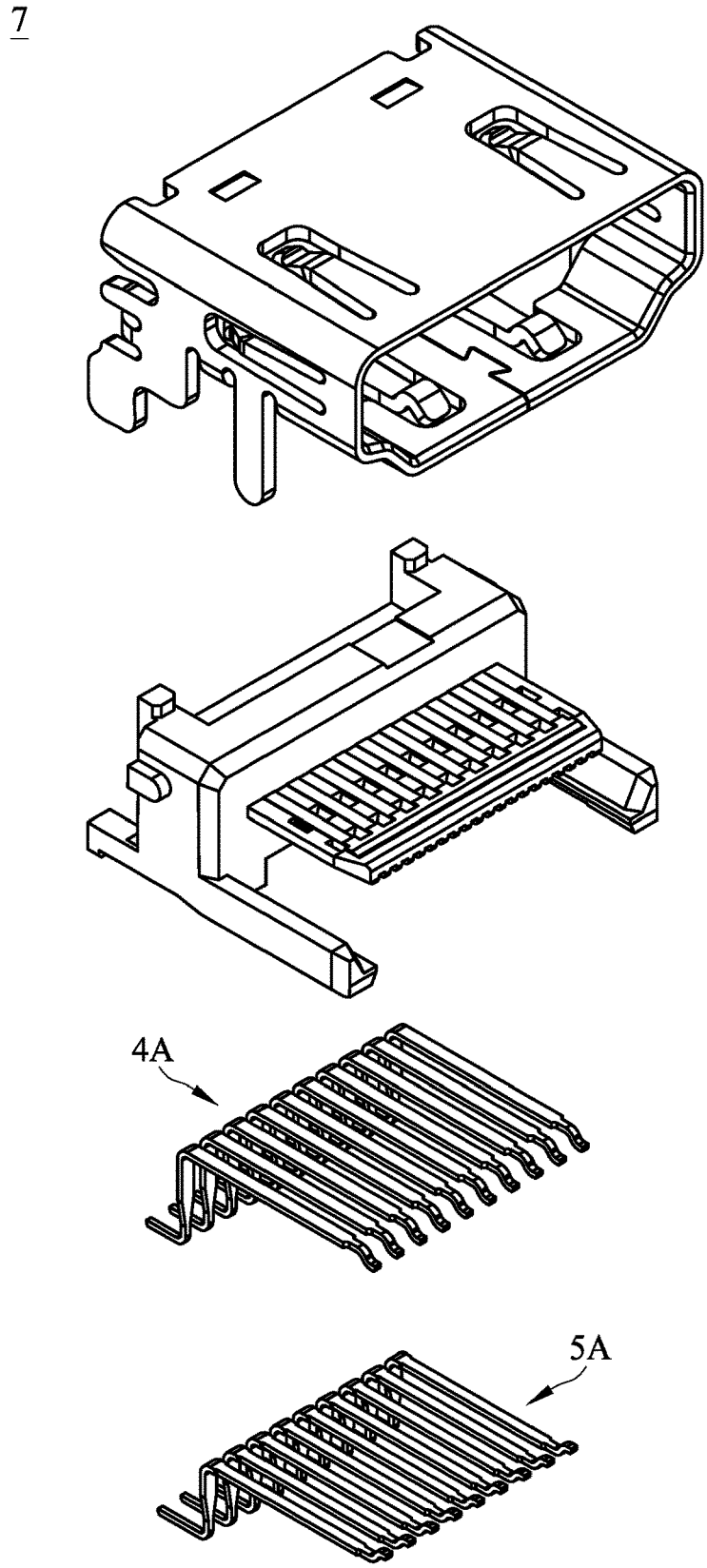
FIG. 10 is a diagram showing stereoscopic appearances for a conventional prior art applied to a first terminal set and a second terminal set of a high-frequency signal connector.
Figure 11:
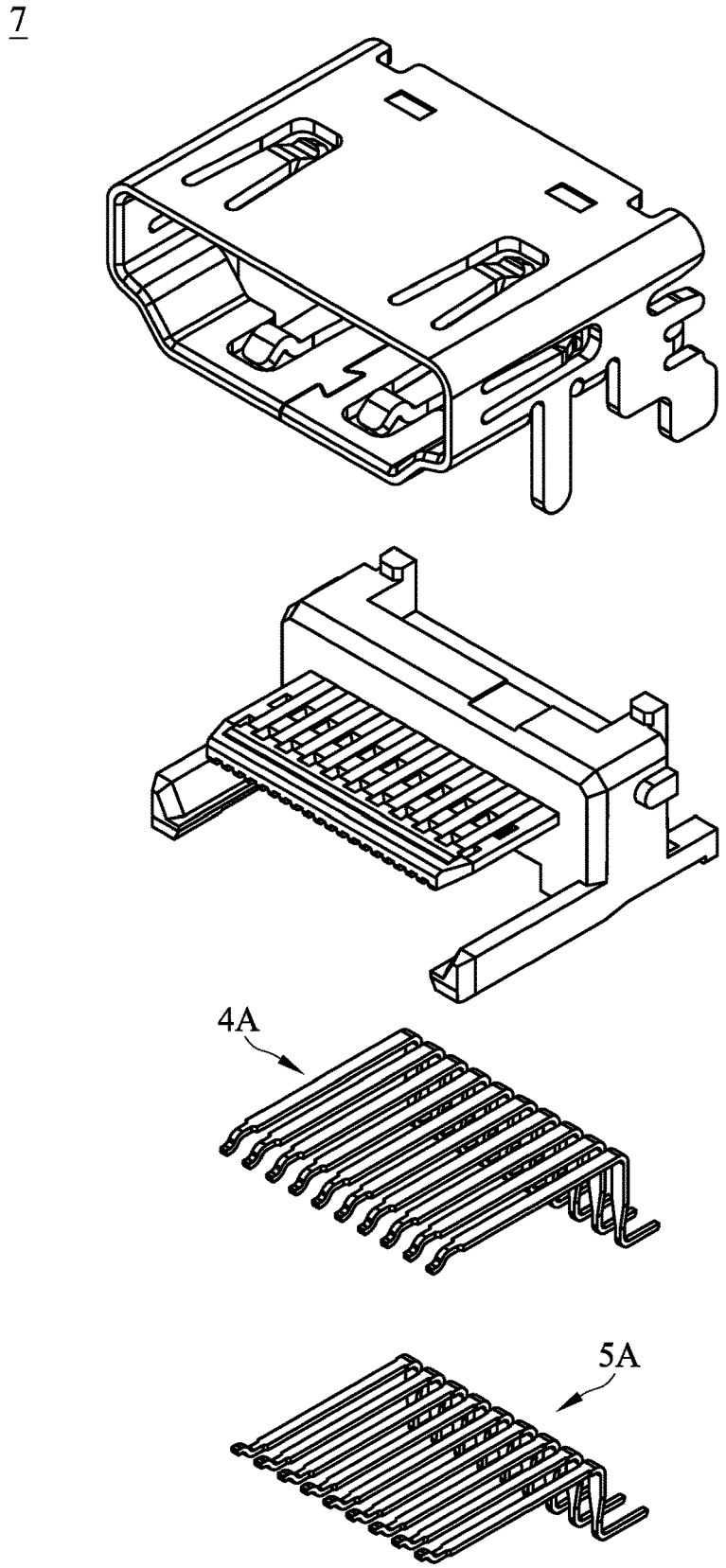
FIG. 11 is diagram showing stereoscopic appearances for FIG. 10 from another perspective.

FIGS. 8 and 9 are diagrams showing stereoscopic appearances of the first terminal set 1 and the second terminal set 2, which are applied to a high-frequency signal connector 6, made by using the one-piece tape manufacturing method according to the invention; FIGS. 10 and 11 are diagrams showing stereoscopic appearances of the first terminal set 4A and the second terminal set 5A, which are applied to a high-frequency signal connector 7, made by using a conventional two-piece tape process.

In summary, the terminal structure of the high-frequency signal connector and the manufacturing method thereof according to the present invention indeed improve the shortages of the conventional prior arts, capable of forming the first terminal set and the second terminal set on a single tape simultaneously, and in turn, reducing disposition of one assembly line and the period for fabricating dies and development of dies, as well as contributing to less waste of metal tape materials after blanking of each of the first terminals and each of the second terminals, to reduce the manufacturing cost of electrical connectors effectively. Moreover, by excavating partial materials on a terminal tape for reducing the area of each of the terminals to achieve the effectiveness of reducing the characteristic impedance of the terminal, the invention has the advantages and effects of advancement, practicality and compliance with needs of industry.

However, what described above are only preferred embodiments according to the invention, and shall not be used to limit the scope of the implementation in accordance with the invention. Therefore, any equivalent changes and modifications made with reference to the scope of the claims and the specifications in accordance with the invention shall be within the scope of the claims covered by the patent to be obtained in accordance with the invention

What is claimed is:

1. A method for manufacturing a terminal structure of a high-frequency signal connector, in which multiple first terminals and multiple second terminals, multiple excavation areas and multiple trimming lines are trimmed from a tape, the first terminals and the second terminals are arranged alternately, each of the trimming lines is located between one of the first terminals and one of the second terminals that are disposed next to each other, the multiple first terminals and the multiple second terminals are divided into multiple pairs of terminals, each of the pairs of terminals includes one of the first terminals and one of the second terminals that are disposed next to each other, each of the excavation areas is only formed in a side, which is disposed toward the second terminal of the same pair of terminals, of the first terminal and a side, which is disposed toward the first terminal of the same pair of terminals, of the second terminal of one of the pairs of terminals, followed by stamping the first terminals and the second terminals to form a first terminal set and a second terminal set.

2. The method for manufacturing the terminal structure of the high-frequency signal connector as claim 1 further comprising trimming the tape to meet dimension specifications with respect to lengths for each of the first terminals and each of the second terminals.

3. The method for manufacturing the terminal structure of the high-frequency signal connector as claim 1 further comprising trimming the tape to meet the dimension specifications with respect to the lengths for each of the first terminals and each of the second terminals when each of the first terminals and each of the second terminals are trimmed from the tape.

4. The method for manufacturing the terminal structure of the high-frequency signal connector as claim 1, wherein the first terminals constitute an upper terminal set of the connector, and the second terminals constitute a lower terminal set of the connector.

5. The method for manufacturing the terminal structure of the high-frequency signal connector as claim 1, wherein each of the excavation areas is in the form of a circle, a square, a diamond, or a trapezoid.

6. A terminal structure of a high-frequency signal connector, including:

multiple first terminals;

multiple second terminals, the first terminals and the second terminals arranged alternately, wherein the multiple first terminals and the multiple second terminals are divided into multiple pairs of terminals, and each of the pairs of terminals includes one of the first terminals and one of the second terminals that are disposed next to each other; and multiple excavation areas, each of the excavation areas only formed in a side, which is disposed toward the second terminal of the same pair of terminals, of the first terminal and a side, which is disposed toward the first terminal of the same pair of terminals, of the second terminal of one of the pairs of terminals, for reducing an area of each of the terminals to reduce a characteristic impedance.

7. The terminal structure of the high-frequency signal connector as claim 6, wherein the first terminals constitute an upper terminal set of the connector, and the second terminals constitute a lower terminal set of the connector.

8. The terminal structure of the high-frequency signal connector as claim 6, wherein each of the excavation areas is in the form of a circle, a square, a diamond, or a trapezoid.

* * * * *